US006389839B1

(12) United States Patent
Sabin

(10) Patent No.: US 6,389,839 B1
(45) Date of Patent: May 21, 2002

(54) COOLING AND DISPENSING OF PRODUCTS

(75) Inventor: Cullen M. Sabin, Cortez, FL (US)

(73) Assignee: Tempra Technologies, Inc., Bradenton, FL (US)

( * ) Notice: Subject to any disclaimer, the term of this patent is extended or adjusted under 35 U.S.C. 154(b) by 0 days.

(21) Appl. No.: 09/850,043

(22) Filed: May 7, 2001

(51) Int. Cl.[7] ..... B67D 5/62; F25B 17/08
(52) U.S. Cl. ..... 62/389; 62/480; 62/101
(58) Field of Search ..... 62/389, 480, 101, 62/515, 457.3, 457.4, 457.9, 294; 165/104.12, 104.21, 274

(56) References Cited

U.S. PATENT DOCUMENTS

| | | | | |
|---|---|---|---|---|
| 4,513,053 A | | 4/1985 | Chen et al. | |
| 4,669,273 A | | 6/1987 | Fischer et al. | 62/294 |
| 4,759,191 A | | 7/1988 | Thomas et al. | 62/101 |
| 4,901,535 A | | 2/1990 | Sabin et al. | 62/101 |
| 4,911,740 A | | 3/1990 | Scheider | 62/4 |
| 4,928,495 A | * | 5/1990 | Siegel | 62/4 |
| 4,949,549 A | | 8/1990 | Steidl et al. | 62/101 |
| 4,974,419 A | | 12/1990 | Sabin et al. | 62/101 |
| 4,993,239 A | | 2/1991 | Steidl et al. | 62/480 |
| 5,018,368 A | | 5/1991 | Steidl et al. | 62/480 |
| 5,035,230 A | | 7/1991 | Steidl et al. | 126/263 |
| 5,048,301 A | | 9/1991 | Sabin et al. | 62/101 |
| 5,168,708 A | * | 12/1992 | Siegel | 62/4 |
| 5,186,020 A | | 2/1993 | Rockenfeller et al. | |
| 5,197,302 A | | 3/1993 | Sabin et al. | 62/477 |
| 5,503,222 A | | 4/1996 | Dunne | |
| 5,950,450 A | | 9/1999 | Meyer et al. | |

OTHER PUBLICATIONS

U.S. application No. 60/121,762, Sabin., filed Feb. 26, 1999.
U.S. application No. 60/121,744, Sabin., filed Feb. 26, 1999.
U.S. application No. 60/121,761, Sabin et al., filed Feb. 26, 1999.

* cited by examiner

*Primary Examiner*—Denise L. Esquivel
*Assistant Examiner*—Chen-Wen Jiang
(74) *Attorney, Agent, or Firm*—Fish & Richardson PC

(57) ABSTRACT

A disposable flow-through refrigeration system includes an evaporator chamber containing a refrigerant, which, during system operation, evaporates to form a vapor; an evacuated absorber chamber including sorbent for receiving the vapor, a heat sink material in thermal contact with the sorbent, and a means for preventing vapor flow from evaporator to absorber until operation of the refrigeration system. The system also includes a primary volume of dispensable product and a product reservoir in fluid communication with each other. The system includes a dispensing means configured to enable controlled withdrawal of a secondary volume of product contained in the reservoir which includes a flow path from the primary volume to the dispensing means. At least one wall of the flow path is in thermal contact with an outer surface of the evaporator chamber during operation of the refrigeration system.

15 Claims, 3 Drawing Sheets

COOLING AND DISPENSING OF PRODUCTS

BACKGROUND OF THE INVENTION

The invention relates to the field of self-refrigerating systems employing evaporation/condensation processes. Specifically, the invention relates to those self-refrigerating systems useful for the chilling of portable and/or disposable liquid containers.

There are many foods and beverages that can be stored almost indefinitely at an average ambient temperature of approximately 20° C.–25° C. but that have more favorable properties when cold than when at ambient temperature. Electrically powered refrigeration units can cool these foods and beverages. The use of these units to cool foods and beverages may not always be practical because the units require a source of electricity, are not usually portable, and may not cool foods and beverages quickly.

Alternatively, phase change materials such as ice can cool foods and beverages. Such phase change materials may not always be available, and may not cool food or beverages sufficiently quickly. Using ice to cool foods or beverages may be undesirable because ice can be stored for only limited times at temperatures above 0° C. Additionally, a beverage can be undesirably diluted by ice that melts while cooling the beverage.

An alternate method for providing cooled food or beverages on demand is to use portable insulated containers. These containers typically only function to maintain the temperature of the food or beverage placed inside them and usually require ice to achieve a cooling effect. These containers can be bulky and heavier than the food or beverage being cooled, especially when used in conjunction with ice. Moreover, ice may not be readily available when a cooling effect is desired.

In addition to cooling food and beverages, there are other applications for which portable cooling devices may be desirable. These include: medical applications, such as cooling of tissues or organs, preparing cold compresses, and cryogenically destroying tissues as part of surgical procedures; industrial applications, such as producing cold water or other cold liquids upon demand, preserving biological specimens, cooling protective clothing; and various cosmetic applications. A portable cooling apparatus could have widespread utility in all these areas.

Some attempts to build a self-contained miniaturized cooling system have depended on the use of a refrigerant liquid stored at a pressure above atmospheric pressure, so that the refrigerant vapor could be released directly to the atmosphere. Unfortunately, many available refrigerant liquids for such a system are either flammable. toxic, harmful to the environment, or exist in liquid form at such: high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling systems which release carbon dioxide are more bulky than is commercially acceptable for a portable system.

An alternate method known in the art for providing (a cooling, effect in a portable device, for example, a beverage can is to evaporate refrigerant in a first chamber and absorb or adsorb the resultant refrigerant vapor in a second chamber. In such a system, liquid refrigerant boils under reduced pressure in the first chamber, absorbing heat from its surroundings. The vapor generated from the boiling liquid is discharged into the second chamber, which contains a desiccant that absorbs the vapor and the heat.

A particular self-refrigerating device that can be used in con unction with the present invention includes three basic sections: an evaporator initially containing a refrigerant, an absorber initially containing a desiccant, and a means to prevent the inadvertent flow of refrigerant vapor between the evaporator and the absorber. This flow-preventing means is also adapted to allow the flow of refrigerant vapor between the evaporator and absorber when, for example, the device is in operation. The functional relationships between these sections have been described in U.S. Pat. Nos. 5,197,302 and 5,048,301, which are incorporated by reference in their entirety.

The configurations which have been available to this point for the cooling of liquids with self-refrigerating systems show that a simple scale up of a single serving system would not function as desired for an application intended to cool a large volume of fluid. The cooling of large volumes of aqueous liquids takes a relatively long time. This delay can be inconvenient for consumers wishing a portion of cold product sooner than it takes to cool the entire volume of product.

SUMMARY OF THE INVENTION

The present invention provides a portable, single-use disposable system for the cooling and dispensing of products. This cooling and dispensing can be implemented by adapting a conventionally manufactured product container to allow the contents of the container to come into contact with a cooling surface of a disposable refrigerator for a time sufficient to cool an internal reservoir portion of the container volume. Alternatively, a system can be fabricated independently of any existing container, and a container can be specifically built for that system. A cooled portion from the internal reservoir can be subsequently dispensed for use. The invention is born out of the recognition that a simple scale-up of conventional self-refrigeration systems does not provide a way to cool a fractional portion of a relatively large volume of product for use on a short time scale without cooling the entire volume. Thus, the invention provides a method for cooling fractions of a large product volume as they are needed.

Refrigerators which can be used in the present invention generally have a fixed ability to absorb heat. If the maximum heat is not provided all at once, the refrigerator idles at a minimum temperature near, but above, the freezing point of the refrigerant. As heat leaks in, the refrigerator can absorb the heat and maintain a minimum temperature. The current invention involves a flow-through system, whereby a product passes through an internal reservoir space before it is dispensed. This internal reservoir space has the capability of cooling the product to a low temperature.

In one aspect a disposable refrigeration system is disclosed for cooling and dispensing a product. The system includes a flow-through refrigeration system that includes an evaporator chamber containing a refrigerant that, during operation of the system, evaporates to form a vapor, an evacuated absorber chamber including a sorbent for receiving the vapor and a heat sink material in thermal contact with the sorbent, a means for preventing the flow of vapor from the evaporator chamber into the absorber chamber until commencement of operation of the refrigeration systems a primary volume of dispensable product, a product reservoir in fluid communication with the primary volume of product containing a secondary volume of product, and a dispensing means allowing controlled withdrawal of the secondary volume of product contained in the reservoir. The reservoir includes a flow path from the primary volume of product to the dispensing means, and at least one wall of the flow path is in thermal contact with an outer surface of the evaporator chamber during operation of the refrigeration system. The product may be a liquid. The liquid may be a potable liquid, which may be a carbonated beverage. The refrigerant may be water. The refrigerant may be supported by a hydrophilic, gel-forming polymer. The means for preventing flow of vapor may include a frangible seal and an actuator. The sorbent may be an aluminosilicate zeolite. The heat sink material may be a phase change material, which may undergo a phase change at a temperature between about 50° C., and about 75° C. Fluid communication from the primary product volume to the product reservoir can be accomplished through gravity feed.

Another aspect includes a method of cooling a dispensable product. The method includes providing a refrigeration system that includes a flow-through refrigeration system. The flow-through refrigeration system includes an evaporator chamber containing a refrigerant. The refrigerant, in operation of the system, evaporates to form a vapor. The flow-through refrigeration system also includes an evacuated absorber chamber including a sorbent for receiving the vapor and a heat sink material in thermal contact with the sorbent, a means for preventing the flow of vapor from the evaporator chamber into the absorber chamber until commencement of operation of the refrigeration system, a primary volume of dispensable product, a product reservoir containing a secondary volume of product, the product reservoir being in fluid communication with a primary volume of product and a dispensing means allowing controlled withdrawal of the product contained in the reservoir. The reservoir includes a flow path from the primary volume of product to the dispensing means, and at least one wall of the flow path is in thermal contact with an outer surface of the evaporator chamber during operation of the refrigeration system. Operating the means for preventing the flow of vapor from the evaporator chamber to the absorber chamber, can allow the flow of vapor between the evaporator and absorber chambers. The refrigeration system can remove the vapor from the evaporator chamber and receive the vapor in the absorber chamber, thereby cooling the secondary volume of product contained in the reservoir. The method may also include dispensing the secondary volume of product by operating a dispensing means. The method can also include refilling the product reservoir by transferring product from the primary volume to the product reservoir. The method can also include transferring a product from the primary volume to the product reservoir by gravity feed.

The invention provides a self-contained and disposable refrigeration system. The system does not typically vent a gas or vapor of any kind. There are no hazardous or toxic materials or components included in the system, and recycling of the materials of the system is facilitated. There are no pressurized gases present in the system and no environmentally objectionable materials such as unstable refrigerants. The system does not explode, even when consumed by fire, and is not flammable.

The refrigeration system can provide cooling of a product having a relatively large volume. In the case of a liquid product, the volume can be at least one liter, and as much as several hundred liters. This aspect of the invention finds utility in the cooling of potable liquids, such as beverages which are preferably consumed at temperatures lower than ambient. Such beverages include soft drinks, milk, water, fruit juices, certain wines, beer and similar beverages. The portable and disposable nature of the system can make it ideal for providing cooled products in locations which are remote from sources of electricity or auxiliary coolants such as ice, or in locations where ice is difficult to transport conveniently.

The invention provides a refrigeration system which can be easily adapted to an existing product container without a re-engineering of the container. By cooling a fractional portion of the product, rather than the entire primary product volume, a consumer can be more effectively served. Also, insulation of the entire primary product volume, to minimize heat leakage back into the product from the surroundings, may be prohibitively expensive. Insulation of the present system, if needed, can be limited to the internal product reservoir.

Unless otherwise defined, all technical and scientific terms used herein have the same meaning as commonly understood by one of ordinary skill in the art to which this invention belongs. Although methods and materials similar or equivalent to those described herein can be used in the practice of the present inventions suitable methods and materials are described below. All publications patent applications, patents, and other references mentioned herein are incorporated by reference in their entirety. In case of conflict, the present specification, including definitions, will control. In addition, the materials, methods, and examples are illustrative only and are not intended to be limiting.

Other features and advantages of the invention will be apparent from the following detailed description, and from the claims.

DETAILED DESCRIPTION OF THE INVENTION

The self-refrigerating system used in the present invention includes a self-refrigeration device having three basic sections: an evaporator chamber containing a refrigerant, an evacuated absorber chamber containing a desiccant and a heat absorber, and a means to prevent the flow of refrigerant vapor between the evaporator chamber and the absorber chamber. This flow-preventing means is also adapted to allow the flow of refrigerant vapor between the evaporator and absorber chambers, such as when the system is in operation. The functional relationships between these sections in a similar refrigeration system have been roughly described in U.S. Pat. Nos. 5,197,302 and 5,048,301. The system further includes a primary product volume and an internal product reservoir. The invention provides a disposable, self-refrigerating system useful for the cooling and dispensing of product. The product can be a liquid product. In some embodiments, the liquid product can be a potable liquid product, or beverage. These products and associated uses will be detailed after discussion of the system itself, which follows directly below.

Figure 1:
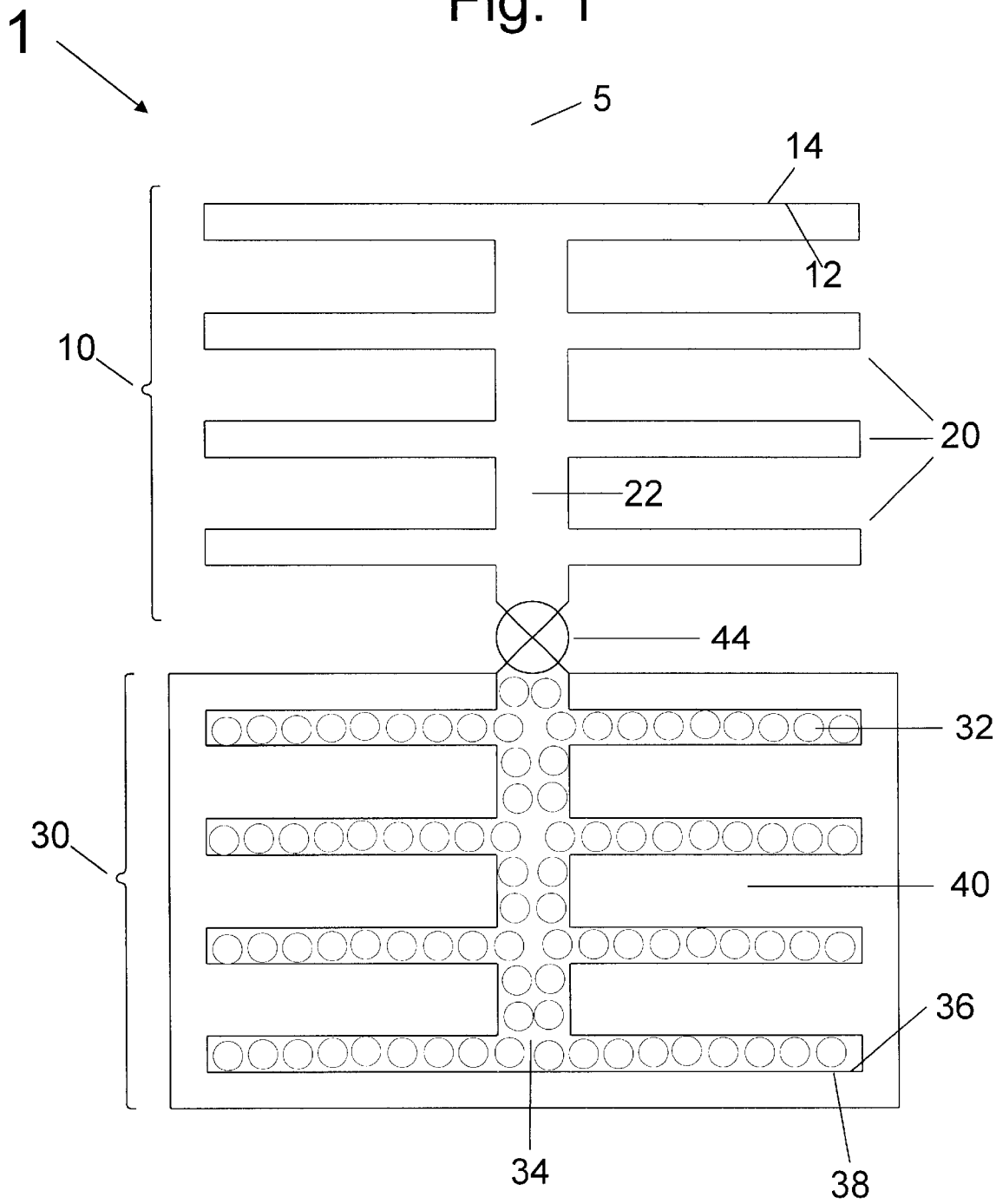
FIG. 1 is a schematic diagram of a refrigeration system useful in certain embodiments of cooling and dispensing systems.

Regarding FIG. 1, a particular embodiment of refrigeration system 1 according to the general principles of the invention is displayed. This view shows product 5, which is to be cooled, in contact with evaporator 10. Product 5 can be contained within a product reservoir, as in the present invention, or more generally, it can be a primary product volume. Evaporator 10 comprises a chamber within which evaporation of a refrigerant occur. This generally involves desorption of refrigerant from an inner surface 12 of the evaporator, during the operation of the system.

Figure 2:
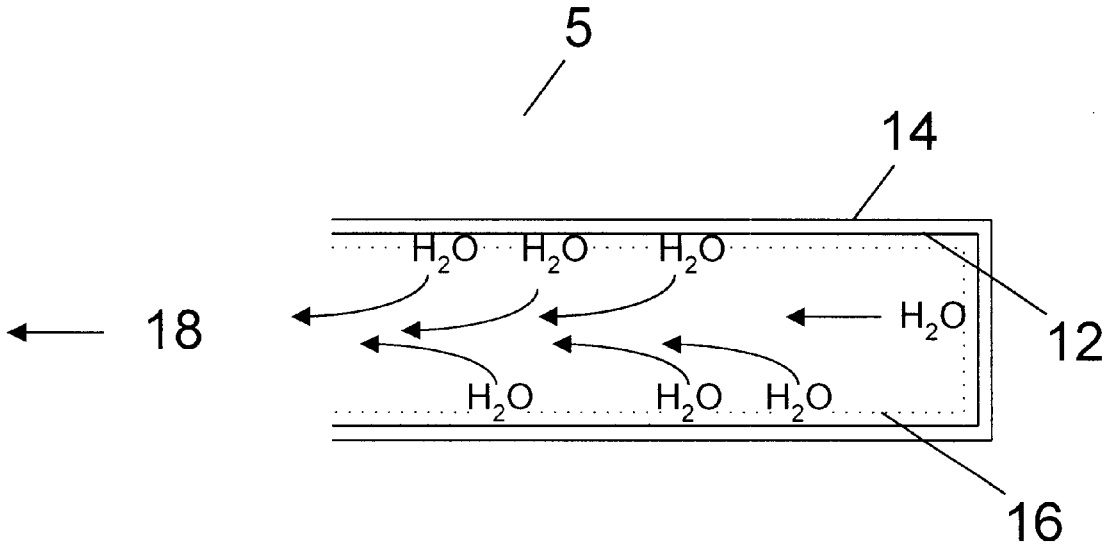
FIG. 2 is a schematic diagram of evaporation and cooling processes occurring at an evaporation chamber during operation of a particular embodiment of a refrigeration system.

Before the system is activated, refrigerant is present in evaporator 10, both in liquid and vaporous states. In systems such as the present invention, this desorption is driven by a pressure differential which is manifested when the flow-preventing means 44 is operated. Thus, operation of the system amounts to allowing refrigerant vapor to flow. As desorption takes place from inner surface 12 of evaporator chamber 10, its outer surface 14 becomes cold. This in turn can cool product 5 which is in thermal contact with outer surface 14. This is represented in FIG. 2, which illustrates the desorption of refrigerant ($H_2O$) proceeding in a direction 18 leading toward lower pressure. This lower pressure is exposed to the refrigerant upon operation of the refrigeration system, as explained herein. The particular embodiment illustrated in FIG. 2 uses water as the refrigerant, but the principles discussed can be applicable to vaporizable refrigerants in general.

A variety of refrigerants can be used in the system. The general requirements are that the refrigerants be vaporizable and condensable at pressures, which can be relatively easily attained in chambers. The refrigerant should also be compatible with a sorbent, which acts to condense the vapor, and absorb heat. The refrigerant vapor should be capable of being absorbed or adsorbed by the sorbent. Suitable choices for refrigerants should also be able to produce a useful change in temperature in a short time, meet Government safety standards, and be relatively compact. The refrigerants used in the systems of the present invention preferably have a high vapor pressure at ambient temperature, so that a reduction of pressure will result in a high vapor production rate. The vapor pressure of the refrigerant at 20° C., is preferably at least about 9 mmHg. Moreover, for some applications (such as cooling of food products), the refrigerant should conform to applicable government standards in case any discharge into the surroundings, accidental or otherwise, occurs. Refrigerants with suitable characteristics for various uses of the invention include: various alcohols, such as methanol and ethanol; ketones or aldehydes, such as acetone and acetaldehyde; ammonia; water; short chain hydrocarbons and short chain halo-hydrocarbons; and FREONS, such as FREONS C318, 114, 21, 11, 114B2, 113, and 112. A preferred refrigerant is water.

In addition, the refrigerant may be mixed with an effective quantity of a miscible nucleating agent having a vapor pressure that is greater than the vapor pressure of the refrigerant to promote ebullition so that the refrigerant evaporates quickly and smoothly, and so that supercooling of the refrigerant does not occur. Suitable nucleating agents for a water refrigerant include ethyl alcohol, acetone, methyl alcohol, propyl alcohol and isobutyl alcohol, all of which are miscible with water. For example, a combination of a inucleating agent with a compatible refrigerant might be a combination of 5% ethyl alcohol in water. The nucleating agent preferably has a vapor pressure at 25° C. of at least about 25 mm Hg. Alternatively, solid nucleating agents may be used, such as conventional boiling stones typically used in chemical laboratory applications.

The refrigeration systems according to the invention contain a fixed amount of non-circulating refrigerant. If the amount of product to be cooled and the amount of cooling desired are known, the amount of heat to be removed can be easily calculated. The amount of heat to be removed specifies precisely the amount of refrigerant which must be evaporated from the evaporator chamber. 1:or example, if 8 fluid ounces (236 mL) of an aqueous liquid is to be cooled by 22° C., about 8.9 grams of water refrigerant is needed as a theoretical minimum. If heat leaks back into the system, more refrigerant may be required.

The desorption processes taking place in the evaporator chamber may be efficiently carried out if the layer of refrigerant is as thin as possible, to the limit of a monolayer of refrigerant spread over as much of the inner desorption chamber surface as possible. These thin films maximize the area for surface evaporation. Multiple layers of refrigerant require heat transfer through layered refrigerant molecules to a refrigerant molecule which is disposed at the innermost surface ol the evaporator. This type of refrigerant overloading results in a temperature difference across the refrigerant layer that is larger than would exist if the layer were thinner. Thus, overloading can decrease heat conduction and reduce the efficiency of evaporation. In preferred embodiments with thin layers of refrigerant, the layer thickness is reduced as the refrigeration system operates, decreasing the temperature difference across the layer, improving heat conduction processes as the refrigerator operates. If a refrigerant dispersant is employed, this is also desirably layered as thinly as possible across as much of the internal evaporator chamber surface as possible.

As mentioned above, the refrigerant desirably forms a layer on inner surface 12 of evaporator 10. This layer of refrigerant is preferably substantially evenly distributed over as much of surface 12 as possible. In certain embodiments of the invention, such as the one shown in FIG. 2, this may be accomplished with the aid of refrigerant dispersant 16, which is preferably deposited in a layer on inner evaporator chamber surface 12, and covers as much of this surface as possible. The layer of dispersant can be adapted to allow refrigerant to be absorbed into and/or adsorbed onto it. A variety of materials are available as refrigerant dispersants, as detailed in Provisional U.S. patent application Ser. No. 60/121,744, entitled "Dispersion of Refrigerant Materials", filed Feb. 26, 1999 and incorporated by reference in its entirety. In such an arrangement, heat flows from the product across the wall of the evacuator chamber, across a layer of refrigerant dispersant, and then vaporizes the surface refrigerant molecules from the dispersant.

In selecting the refrigerant dispersant, any of a number of materials may be chosen, depending upon the requirements of the system and the particular refrigerant being used. The refrigerant dispersant may be something as simple as cloth or fabric having an affinity for the refrigerant and a substantial wicking ability. Thus, for example, when the refrigerant is water, the refrigerant dispersant may be cloth, sheets, felt or flocking material which may be comprised of cotton, filter material, natural cellulose, regenerated cellulose, cellulose derivatives, blotting paper or any other suitable material. It is important that the refrigerant dispersant be able to be applied to a surface which is highly thermally conductive, such as a metal-containing surface.

The most preferred refrigerant dispersant would be highly hydrophilic, such as gel-forming polymers which would be capable of coating the interior surface of the evaporation chamber. Such materials are recited, and methods for their preparation are given in Provisional U.S. patent application Ser. No. 60/121,744, entitled "Dispersion of Refrigerant Materials". filed Feb. 26, 1999, which is incorporated by reference in its entirety.

The refrigerant dispersant may be sprayed, flocked, or otherwise coated or applied onto the interior surface of the evaporator chamber. In a preferred embodiment, the refrigerant dispersant is electrostatically deposited onto the surface. In another embodiment, the refrigerant dispersant is mixed with a suitable solvent, such as a non-aqueous solvent, and then the solution is applied to the interior surface of the evaporator chamber.

In another preferred embodiment, the refrigerant dispersant can control boiling of the evaporator and thus reduce any liquid entrainment in the vapor phase. In such an embodiment, the refrigerant dispersant is a polymer forming a porous space-filling or sponge-like structure, and may fill all or part of the evaporator chamber.

Figure 3:
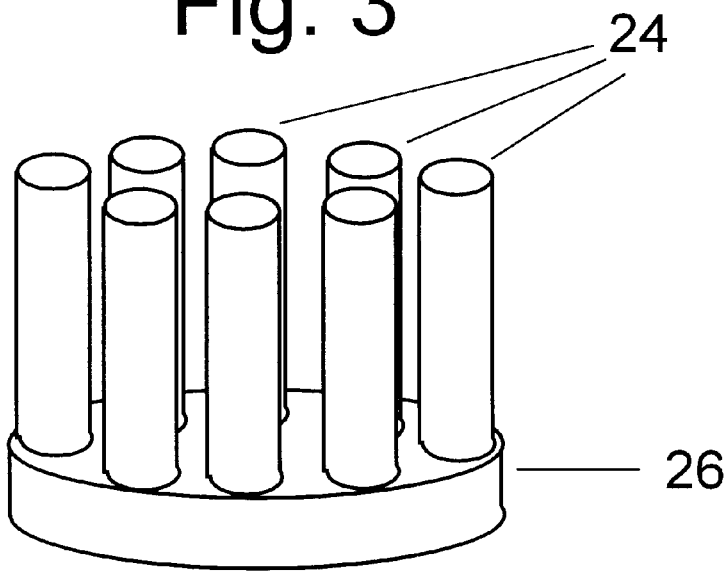
FIG. 3 is a schematic diagram of a particular embodiment of an evaporator portion of a cooling and dispensing system.

In the particular embodiment shown in FIG. 1, evaporator 10 has fins 20 and a central passage 22, although a variety of shapes and configurations of the evaporator 10 are possible. If fins 20 are used, they can be of a large variety of configurations, and the central passage 22 may be omitted or substantially shortened. In other embodiments, evaporator 10 takes the form of a number of hollow finger-like elements (fingers 24) which do not branch from a central passage as do fins 20, but pass into finger base 26, shown in FIG. 3. Base 26 can contain short passages (not shown in FIG. 3) to connect the interior of hollow fingers 24 together to form a central passage. Alternatively, base 26 can be substantially hollow, with a central outlet leading to the means for preventing/allowing vapor flow to the absorber. Fingers 24 can be arranged in a circle, a number of concentric circles, in a cruciform arrangement, or a more random arrangement. The general aim is to provide for efficient heat transfer from the bulk medium to inner evaporator 12, by maximizing the area of this surface. The evaporator is desirably also reasonably simple to manufacture and assemble. Additionally, refrigerant vapor flow paths inside the evaporator chamber are desirably adequate to prevent excessive pressure drops.

Normal boiling processes (ebullition), which are typically initiated by streams of tiny bubbles rising from discrete and easily visible spots on surfaces, require nucleation sites consisting of reentrant cavities containing non-condenisable gases such as air. The evaporator chamber in refrigerators according to the present invention is subjected to partial evacuation, effectively removing nucleation sites from the internal surfaces of the evaporator chamber, and degasses the refrigerant as well. Thus, religerant molecules prepared according to the evacuator chamber preparation methods (described, for example, in Provisional U.S. patent application Ser. No. 60/121,744, filed Feb. 26, 1999, entitled "Dispersion of Refrigerant Materials", which can also be used for refrigerators of the present invention), when exposed to the reduced pressure present in a properly prepared absorber chamber (described for example, in Provisional U.S. patent application Ser. No. 60/121,762, filed Feb. 26. 1999, entitled "Preparation of Heat Sink Materials"), evaporate from the surface of a quiescent pool of refrigerant. Heat transfer in such a pool is subject to the same limitations of conduction and convection as in bulk fluids.

The refrigerant vapor pressure within the evaporator chamber at the beginning and end of the cooling process can be determined from the equilibrium vapor pressure-temperature function for water, based on the expected beverage temperatures and temperature differences required for heat transfer.

It may be desirable to carry out an evacuation of the refrigerant-loaded evaporator chamber before assembly. The evacuation should be limited to pressures above or equal to the vapor pressure of water at the temperature at which the evacuation is carried out, in order that substantial amounts of refrigerant not be removed from the evaporator prior to use. For example, at room temperature with water as the refrigerant, the evacuation of the refrigerant-loaded evaporator should be carried out to pressures of about 20 Torr. This evacuation serves to sweep the majority of contaminants such as air, wash solvents and the like from the evaporator chamber.

Returning to FIG. 1, there is also shown sorber 30. This section of the refrigeration system includes sorbent 32, which is disposed throughout the interior of sorbent chamber 34. Also included in sorber 30 is heat sink 40. Refrigerant vapor which is formed upon operation of the refrigeration system moves from the evaporator chamber into sorbent chamber 34, carrying heat. This heat is deposited into finite capacity sorbent 32, and further deposited into finite capacity heat sink 40.

The sorbent 32 receives heat not only from the latent heat of vaporization resulting from condensation of the refrigerant vapor, but also from the chemical reaction heat released when refrigerant is combined with the sorbent 32. Sorbent 32 is in thermal contact with heat sink 40, via internal surface 36 and external surface 38 of sorbent chamber 34. This thermal contact desirably results in highly efficient heat transfer from sorbent 32 to heat sink 40. This heat should be stored in the heat sink 40 in such a manner that it does not appreciably leak back into the product during the time that cold product is required.

Gas molecules tend to adhere to surfaces. Sorbent materials can have porous structures with a very large surface area per unit volume. The volume of non-condensable materials can be significant in systems requiring final pressures below 220 to 500 milliTorr. As an example, a container filled with molecular sieve (a typical sorbent) can be evacuated at room temperature to a pressure of from about 1 to 5 milliTorr day after day, but may rise in pressure over a few hours to as much as 500 milliTorr between serial evacuations. This rise can be attributed to the gradual desorption of sorbed gas molecules. It is unlikely that an economical high production rate refrigeration system could incorporate such a process in its manufacture. Since the sorption process in the sorbent acts as a pump to draw vapor from the evaporator during operation of the system, the refrigerant vapor pressure over the sorbent should at all times be well below the equilibrium saturation pressure of refrigerant in the evaporator. Important to the usefulness of sorbents in the refrigeration systems discussed herein is the removal of non-condensable gases from the refrigeration system. The presence of non-condensable gases should be avoided as far as practicable anywhere in the system, for such gases might be carried by the flowing refrigerant vapor into the sorber, or could be already present in or on the sorbent. The presence of non-condensable gases can form a barrier through which refrigerant vapor must diffuse before it can condense. If such gases are present, the refrigeration system might operate at a rate which is limited by the diffusion barrier. Such operation is not optimized operation.

The sorbent should be made as free of condensable gases as possible before the system is operated. The volume of the sorbent is desirably minimized for some preferred embodiments of the invention. Thus, competition between refrigerant and a condensable gas already present in the sorbent may also limit the operation of the refrigeration system to levels below optimum performance. Methods for preparing various sorbents for use in refrigeration systems are detailed in Provisional U.S. patent application Ser. No. 60/121,761, entitled "Preparation of Refrigerant Materials", filed Feb. 26, 1999, which is incorporated by reference in its entirety.

Materials which may be suitable as sorbents are those which have aggressive refrigerant vapor-binding properties, low chemical reaction heats, and are not explosive, flammable or toxic. These materials are typically available in a variety of forms, including flakes, powders, granules, as well as supported on inert shapes or bound with clays. It is desirable that the material have sufficient vapor flow passages through it that refrigeration performance is not limited by the passage of refrigerant vapor through the sorbent. Additionally, the sorbent should be able to transfer heat to the heat sink material, and thus should be in good thermal contact with the inner surface of the absorber chamber. Preferred sorbents for use in the present refrigeration system can include flaked sorbent or clay-supported sorbent. The latter is available in a variety of shapes, including spheres, chips, rectangular solids.

Synthetic zeolite materials comprising metallic alumino silicates can be used in the present refrigeration systems. These materials include a water-absorbing mineral supported by a porous inert clay. Such materials should be heated to drive absorbed and adsorbed water from them. Suitable materials and methods of preparation for use in refrigerators suitable for use in the present invention are described in Provisional U.S. patent application Ser. No. 60/121,761, filed Feb. 26, 1999, entitled "Preparation of Refrigerant Materials", which is incorporated by reference in its entirety.

The amount of sorbent required to absorb refrigerant vapor typically depends on the sorption capability of the sorbent for the refrigerant vapor. This is generally a function of temperature.

The sorbent chamber into which the sorbent is to be loaded can also include a heat sink material. The function of the heat sink material is to absorb heat released by the sorbent, and to prevent leakage of this heat back to the product which is to be cooled by the refrigeration system. Thus, it is critical to maximize the thermal contact between the sorbent and the heat sink material.

When heat is added to a material which does not melt or evaporate as a result of that heat addition, the heat can be sensed by an increase in temperature. By contrast, if the material undergoes a phase change, from solid to liquid for example, the material can absorb heat without a sensible temperature change. The heat energy instead goes into the phase change of the material. The hidden heat is referred to as latent heat, pleat sink materials useful in the present refrigeration system are typically all melting materials; they absorb significant latent heat, and are able to keep the sorbent at an even temperature. The cooler the sorbent, the more vapor it can condense, so it is the combined volume of heat sink and sorbent that is of direct interest. A low density material and a high density material may, in principle, has equal total heat capacity, but a refrigeration system utilizing the low density material will require more volume. This increased volume can be undesirable in certain critical applications. Suitable heat sink materials and methods for preparation of such materials for use in refrigerators which are useful in the present invention are described in Provisional U.S. patent application Ser. No. 60/121,762, filed Feb. 26, 1999, entitled "Preparation of Heat Sink Materials", which is incorporated by reference in its entirety.

Suitable phase change materials for particular applications may be selected from paraffin, naphthalene, sulfur, hydrated calcium chloride, bromocamphor, cetyl alcohol, cyanimede, eleudic acid, lauric acid, hydrated sodium silicate, sodium thiosulfate pentahydrate, disodium phosphate, hydrated sodium carbonate, hydrated calcium nitrate, Glauber's salt, potassium, sodium and magnesium acetate, including hydrated forms of these materials, such as sodium acetate trihydrate, and disodium phosphate dodecahydrate. The phase change materials remove some of the heat from the sorbent material simply through storage of sensible heat. In other words, they heat up as the sorbent heats up, removing heat from the sorbent. However, the most effective function of the phase change material is in the phase change itself. A large quantity of heat can be absorbed by a suitable phase change material in connection with the phase change (i.e., change from a solid phase to a liquid phase, or change from a liquid phase to a vapor phase). There is typically no change in the temperature of the phase change material during the phase change, despite the relatively substantial amount of heat required to effect the change, which heat is absorbed, during the change. Phase change materials which change from a solid to a liquid, absorbing from the sorben it their latent heat of fusion, may be practical in a closed system. However, a phase change material changing from a liquid to a vapor is also feasible. Thus, an environmentally-safe liquid could be provided in a separate container (not shown) in contact with the sorbent material (to absorb heat therefrom) but vented in such a way that the boiling phase change material carries heat away from the sorbent material and entirely out of the system.

Another desirable characteristic of the phase change materials is that they change phase at a temperature greater than the expected ambient temperature of the material to be cooled, but less than the temperature achieved by the sorbent material upon absorption of a substantial fraction (i.e., one-third or one-quarter) of the refrigerant liquid. Thus, for example, in most systems according to the present invention which are intended for use in cooling material such as food or beverage, the phase change material could change phase at a temperature above about 30° C., preferably above 35° C., but preferably below about 70° C., and most preferably below 60° C. In some applications substantially higher or lower phase change temperatures may be desirable. Indeed, many phase change materials with phase change temperatures as high as 90° C., or 110° may be appropriate in certain systems.

Materials that have a heat capacity greater than that of the sorbent can provide a thermal mass in contact with the sorbent that does not affect the total amount of heat in the system, but reduces the temperature differential between the material being cooled and the sorber, with two results.

The amount of heat sink material required depends on the amount of refrigerant vapor to be absorbed by the sorbent, the chemical reaction heat of the sorbent and refrigerant vapor binding reaction, the specific heat of the heat sink (or specific heat-latent heat combination in a phase-change material), and the chosen final temperature of the absorber. Since most sorbents decrease in refrigerant vapor sorption capability as the temperature increases, there is a ratio of sorbent to heat sink which yields minimum system mass, and which depends on the properties of the chosen pair.

The refrigeration system also includes a means for preventing refrigerant vapor flow from the evaporator chamber to the sorbent chamber before operation of the system. Upon activation of this means, which subsequently allows the flow of refrigerant vapor from the evaporator chamber to the sorbent chamber, desorption and cooling of product begins. The means for preventing vapor flow can take the form of any of the various types shown in the prior art. The means can be located at any location between the evaporator chamber and the sorber, so long as it prevents refrigerant vapor, or vapor of any kind from being sorbed by the sorbent. However, if the entire refrigeration system is contained within a pressurized container, a pressure responsive valve can be used which can actuate the system upon the release of the pressure within the container.

The system can be constructed of a variety of materials, with the restriction that certain portions should be able to afford good thermal contact with certain other portions. These portions should be made of a relatively good thermal conductor such as a metal or metallic material. Preferred materials for the evaporator chamber, and sorber include metals such as aluminum, copper, tin, steel, and metal alloys such as aluminum alloy. For some applications, corrosion protection may be required on the outer surface of the evaporator. Corrosion protection can include a thin coating of a lacquer specially designed for that purpose. Those of skill in the art will be able to provide suitable materials. The thickness of such coatings generally does not interfere with thermal transfer, but the choice of corrosion protectant will be dictated by the effect such protectant has on the heat transfer. Portions of the refrigerator which may not be crucial to thermal transfer include the means for preventing/allowing refrigerant vapor flow. This portion can typically be made of a polymeric material, such as a thermoplastic material.

The refrigeration system includes a primary product volume. This product is desirably provided to the user in a cooled state, although the entire primary product volume need not be cooled at the same time. The invention includes an internal product reservoir, the contents of which are preferably cooled to the temperature of interest, while the primary product volume can be used to refill the reservoir as needed.

The products which are useful, in the present invention include liquid products, including aqueous-based liquids. Among the aqueous-based liquids which are desirably provided at temperatures below that of ambient temperature are potable aqueous-based liquids, such as beverages. A wide variety of beverages can be utilized in the present refrigeration system, including naturally available beverages such as water, milk, and fruit juices, as well as those natural beverages undergoing some processing such as fermented beverages such as beer and certain wines which are desirably served cold. Other useful beverages include soft drinks. Any of the above mentioned beverages can be carbonated, either naturally or by other processes.

The amount of primary product volume can be readily adjusted to provide for a variety of consumer desires. The volume of product can be as low as perhaps 10 mL or as great as several liters, even up to 20 L. The cooling capacity of the refrigeration system can be adjusted to provide cooling for varying lengths of time. For example, the refrigeration system can provide for cooling of a 1 L product over a half-hour period.

Because the present refrigeration system may tend to idle if maximum heat is not provided, advantage can be take of this fact, and fractional portions of the primary product volume can be cooled for occasional withdrawal as needed. The rate at which a refrigeration system can move heat from evaporator chamber to absorber chamber is a function of temperature. The principal contributor to this function is the vapor pressure of the refrigerant, which becomes small as its freezing point is approached. If water is used as the refrigerant, it is possible to build up ice on the inner surface of the evaporator chamber. The very low rate of heat flow which is obtained by the sublimation of ice as the refrigerant on the inner surface of the evaporator chamber in this instance reduces the rate at which a product can be cooled on the outer surface of the evaporator chamber. The practical lower limit for the temperature of a product cooled by this particular embodiment of the refrigeration system may be from about 1 to 4° C. Therefore, a product initially at about 15° C. may only drop in temperature about 12° C. or so, even if the refrigeration system had excess capacity for cooling. The system would remain at minimum temperature, with the refrigeration system functioning at a lower rate to hold the product at 1–4° C., while compensating for heat leakage into the system, until the refrigerant and its vapor were expended. Similarly, if a refrigeration system were designed to cool an entire volume of product at acertain rate, smaller portions of the product may be available at minimum temperature in a shorter time. The smaller portion could be dispensed for use, and an internal product reservoir could be simultaneously refilled for cooling the next desired smaller portion.

The present invention includes an internal product reservoir. This reservoir includes a flow path from the primary product volume to the dispensing means. At least a portion of the product reservoir may be in thermal contact with at least a portion of the outer surface of the evaporator chamber of the refrigeration system during operation of the system. The thermal contact may also be established before the system is activated to provide cooling.

The internal product reservoir and the primary product volume should be in fluid communication, or be separated only by a valve which can provide fluid communication. The product reservoir is also in fluid communication with a dispensing means. Desirably, the act of dispensing some or all of the product contained in the product reservoir will cause the transfer of that volume from the primary product volume into the reservoir where it is to be cooled. This can be accomplished by means of a gravity flow arrangement.

The volume of the product reservoir is generally less than half of the primary product volume, although there is no strict requirement that it be so. The volume of the product reservoir will generally be matched to specific applications and to consumer expectations. For example, if the product is a mass-produced carbonated beverage, the internal product reservoir might typically hold between 20 and 300 mL of product.

Figure 4:
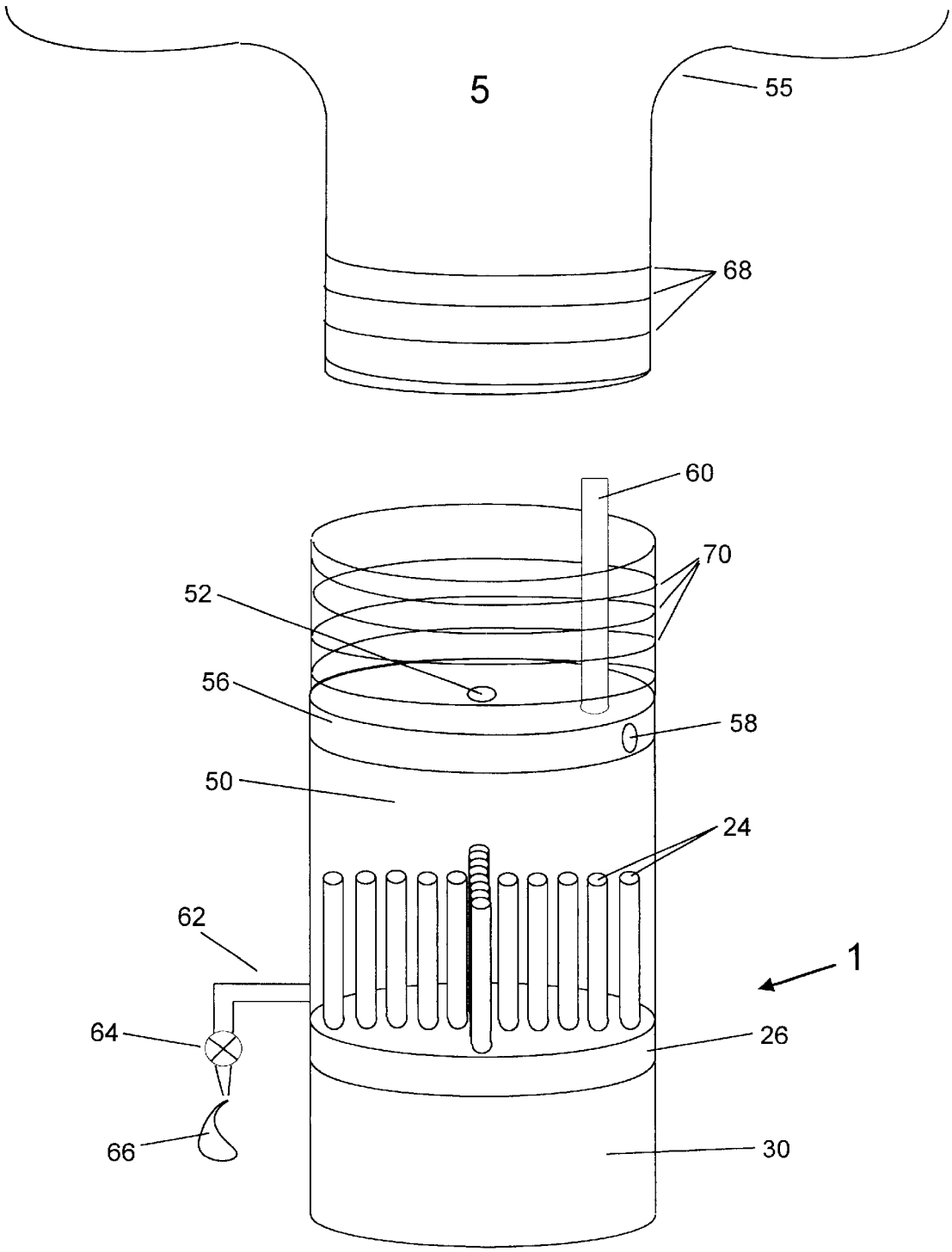
FIG. 4 is a side view diagram of a particular embodiment of a cooling and dispensing system, showing how a refrigerator could be used in combination with an existing product container.

In FIG. 4, refrigerator assembly 1 is shown in an arrangement that could be used in conjunction with a prefabricated product container 55. This figure is not necessarily to scale, since in some embodiments, for example, refrigerator assembly 1 may be somewhat larger than the neck of container 55. Other aspects of the illustrated embodiment which are also not critical to the function of the system are mentioned herein. These illustrated aspects do not affect the general relationship between the various parts of the system discussed herein. Additionally, FIG. 4 shows refrigerator assembly 1 and primary product container 55 separated from each other for clarity, although these parts could be joined together to provide a leak-free system when in use.

In FIG. 4, evaporator fingers 24 extend into internal reservoir 50. As discussed, the configuration of these fingers can take a wide variety of arrangements. The fingers can extend completely to the top of the internal product reservoir, or, as shown in FIG. 4, they can be somewhat shorter than the height of the reservoir. Internal reservoir 50 includes product inlet 52 from primary product volume 5, which is contained in primary product container 55 (shown incompletely). Container 55 can be either open or closed, although it will be closed at the top in many useful embodiments. For example, container 55 can be a prefabricated bottle for containing liquids, and can include polyethylene terephthalate bottles having volumes that typically range from 200 mL to 5 L or more.

Product inlet 52 is shown as a narrow passage through upper reservoir wall 56. Optionally, a one-way pressure-actuated valve could be installed over the inlet to further insulate the contents of internal reservoir 50 (which is to be cooled) from primary product volume 5. Upper reservoir wall 56 is preferably constructed of a material which provides effective thermal insulation between these regions. Also passing through upper reservoir wall 50 is port 58, leading to air inlet tube 60. This portion of the system reestablishes approximately atmospheric pressure into the primary product container as product is withdrawn from it. In embodiments in which container 55 is open at the top, this may not be a necessary part of the system. Port 58 can allow air to enter primary product container 55 through the side of upper reservoir wall 56. Although air inlet tube 60 is shown here as relatively short, it can optionally be much longer, reaching to the top, or close to the top of primary product container 55. If the product to be cooled and dispensed is carbonated, the pressure above the liquid will assist in the dispensing of the product, with somewhat less need for reestablishing atmospheric pressure above the product.

Internal product reservoir 50 also has outlet 62, which comprises a passage from reservoir 50 to dispensing means 64, which may be piping, tubing or other means for transporting cooled product from the reservoir to the consumer. Dispensing means 64 can take many forms including such means as valves, spigots, faucets, nozzles or other means known to those of skill in the dispensing arts. An actuator can also be included to operate the valve, spigot, faucet, nozzle or other means. Cooled product 66 can be dispensed into a suitable container for use.

Primary product container can be any of several typically available vessels useful for containing various products, including cans, bottles, cartons, and the like. Alternatively, it can be specially designed for use with the present system. For example, in one application, the inventive flow-through refrigeration system is mounted at the opening of a 1 liter bottle which may be used to contain carbonated beverage. In such an arrangement, the bottle would be inverted with respect to its usual orientation, with the mouth of the bottle at the bottom. The mouth could lead directly to the internal product reservoir, or could lead to the reservoir indirectly, such as through a baffle, or a valve which operates by gravity feed. Thus, male-threaded closure 68 of the bottle could be screwed directly into female-threaded closure 70 of the inventive system, as shown in FIG. 4. This allows the use of such a refrigeration/dispensing system with a minimal redesign of the product vessel. The assembly would be self-supporting in such a case, so that it could be placed at the edge of a table for convenient dispensing. Other methods of closure could be used to mate refrigerator assembly 1 and primary product container 55, including pressure-fit connections, adhesive-assisted closure, and many other methods known in the art.

For purposes of manufacture and shipment, some embodiments of the cooling and dispensing system of the invention will have the internal reservoir initially unfilled with product. The reservoir would of course be filled with product in the course of preparing the system for use by a consumer. Thus, there is optionally a means for filling the internal product reservoir with product from the primary product volume before, or during, activation of the self-refrigeration unit of the system. This could be accomplished by gravity feed from the primary product volume, through a valve, removable seal, or other means known to those skilled in the art.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A disposable refrigeration system for the cooling and dispensing of a product, said system compring:

A) a flow-through refrigeration system comprising:

1) an evaporator chamber containing a refrigerant, wherein the refrigerant, in operation of the system, evaporates to form a vapor;

2) an evacuated absorber chamber comprising a sorbent for receiving the vapor and a heat sink material in thermal contact with the sorbent; and 3) a means for preventing the flow of vapor from the evaporator chamber into the absorber chamber until commencement of operation of the refrigeration system;

B) a primary volume of dispensable product;

C) a product reservoir in fluid communication with the primary volume of product containing a secondary volume of product and D) a dispensing means allowing controlled withdrawal of the secondary volume of product contained in the reservoir wherein the reservoir comprises a flow path from the primary volume of product to the dispensing means, at least one wall of the flow path being in thermal contact with an outer surface of the evaporator chamber during operation of the refrigeration system.

2. The refrigeration system of claim 1, wherein the product is a liquid.

3. The refrigeration system of claim 2, wherein the liquid is a potable liquid.

4. The refrigeration system of claim 3, wherein the potable liquid is a carbonated beverage.

5. The refrigeration system of claim 1, wherein the refrigerant is water.

6. The refrigeration system of claim 1, wherein the refrigerant is supported by a hydrophilic gel-forming polymer.

7. The refrigeration system of claim 1, wherein the means for preventing flow of vapor comprises a frangible seal and an actuator.

8. The refrigeration system of claim 1, wherein the sorbert is an aluminosilicate zeolite.

9. The refrigeration system of claim 1, wherein the heat sink material is a phase change material.

10. The refrigeration system of claim 9, wherein the phase change material undergoes a phase change at a temperature between about 50° C., and about 75° C.

11. The refrigeration system of claim 1, wherein fluid communication from eh primary product volume to the product reservoir is by gravity feed.

12. A method of cooling a dispensable product, the method comprising the steps of:

A) providing a refrigeration system comprising:

1) a flow-through refrigeration system comprising:

a) an evaporator chamber containing a refrigerant, wherein the refrigerant, in operation of the refrigeration system, evaporates to form a vapor;

b) an evacuated absorber chamber comprising a sorbent for receiving the vapor and a heat silk material in thermal contact with the sorbent; and c) a means for preventing the flow of vapor from the evaporator chamber into the absorber chamber until commencement of operation of the refrigeration system;

2) a primary volume of dispensable product;

3) a product reservoir containing a secondary volume of product, wherein the product reservoir is in fluid communication with the primary volume of dispensable product; and 4) a dispensing means configured to enable controlled withdrawal of the secondary volume of product contained in the product reservoir;

wherein the product reservoir comprises a flow path from the primary volume of dispensable product to the dispensing means, at least one wall of the flow path being in thermal contact with an outer surface of the evaporator chamber during operation of the refrigeration system;

B) operating the means for preventing the flow of vapor from the evaporator chamber into the absorber chamber, so as to allow the flow of vapor between the evaporator chamber and the absorber chamber; and C) removing the vapor from the evaporator chamber by receiving the vapor in the absorber chamber, thereby cooling the secondary volume of product contained in the product reservoir.

13. The method of claim 12, further comprising dispensing the secondary volume of product by operating the dispensing means.

14. The method of claim 13, further comprising refilling the product reservoir by transferring the dispensable product from the primary volume to the product reservoir.

15. The method of claim 14, where the dispensable product is transferred from the primary volume to the product reservoir by gravity feed.

* * * * *